US005797435A

United States Patent [19]

Wada

[11] Patent Number: 5,797,435

[45] Date of Patent: Aug. 25, 1998

[54] APPARATUS FOR FILLING POWDER

[75] Inventor: Yasutaro Wada, Suita, Japan

[73] Assignee: Carbone Industrie, Villeurbanne Cedex, France

[21] Appl. No.: 776,837

[22] PCT Filed: Aug. 22, 1995

[86] PCT No.: PCT/JP95/01645

§ 371 Date: Feb. 13, 1997

§ 102(e) Date: Feb. 13, 1997

[87] PCT Pub. No.: WO96/06009

PCT Pub. Date: Feb. 26, 1996

[30] Foreign Application Priority Data

Aug. 23, 1994 [JP] Japan ..... 6-233992

[51] Int. Cl.[6] ..... B65B 1/10

[52] U.S. Cl. ..... 141/81; 141/65; 141/67; 141/81; 141/144; 141/183; 222/306; 222/368; 222/636

[58] Field of Search ..... 141/65, 67, 81, 141/144, 183; 222/306, 368, 636

[56] References Cited

U.S. PATENT DOCUMENTS 2,540,059 1/1951 Stirn et al. ..... 141/419
2,730,285 1/1956 Lazzery ..... 141/183
3,633,797 1/1972 Graff ..... 222/636
3,656,518 4/1972 Aronson ..... 141/67
4,848,421 7/1989 Froese et al. ..... 141/144

*Primary Examiner*—J. Casimer Jacyna
*Attorney, Agent, or Firm*—Bacon & Thomas

[57] ABSTRACT

This invention is directed to an apparatus for filling powder which comprises introducing a predetermined amount of powder into each of the receiving holes formed at the peripheral edge portion of a rotary disk from a powder hopper, intermittently rotating the rotary disk, and discharging and filling the powder accommodated in each of the receiving holes into a powder container positioned therebelow when each of the receiving holes reaches a discharging and filling portion. The rotational axis (C) of the rotary disk (1) is inclined. The center axis of each of the receiving holes (8) is arranged on an imaginary conical surface (12) having this rotational axis (C) as its center axis and an apex angle (θ) of 60° to 120°. The powder hopper (6) is disposed on the lateral side portion of an opening (8*a*) of the receiving hole (8) at a vacuum sucking portion (9) and a boss portion (28) supporting the rotational axis (34) of the agitator (7) is arranged above the powder hopper (6). This apparatus is suitable for being used at the step of filling various kinds of powder, especially injection or the like powdered pharmaceutical product requiring the accuracy of the amount to be filled and the non-contamination of foreign matters, into vials or the like containers.

6 Claims, 8 Drawing Sheets

- PRIOR ART -

-PRIOR ART-

-PRIOR ART-

APPARATUS FOR FILLING POWDER

BACKGROUND OF THE INVENTION

1. Field of the Invention

The present invention relates to an apparatus for filling powder, which introduces a predetermined amount of powder into each of receiving holes formed at the peripheral edge portion of a rotary disk from a powder hopper, intermittently rotates the rotary disk, and discharges and fills the powder introduced into the receiving holes, into powder containers disposed below the receiving holes when the receiving holes reach a discharging and filling portion.

2. Description of the Related Art

Conventionally known as an apparatus for filling powder by utilizing a rotary disk, which is formed with a plurality of receiving holes at the peripheral edge portion of a rotary disk and adjusts the amount to be filled by the receiving holes and then fills a predetermined amount of powder into each of powder containers is the apparatus disclosed in, for example, U.S. Pat. No. 2,540,059 or Japanese Patent Publication No. Hei 4-22761.

These apparatuses are each provided with a rotary disk (51) at the peripheral edge portion of which a plurality of receiving holes (58) are equidistantly formed, an intermittent rotation drive shaft (52) interlockingly connected to the rotary disk (51), a slide valve (53) having a sucking port (54) and a discharging port (55), and a powder hopper (56) having an agitator (57) arranged therein, for example, as shown in FIGS. 8 to 10. The rotary disk (51) is disposed below the powder hopper (56) with its rotational axis (C) positioned horizontal. The rotary disk (51) is provided with a vacuum sucking portion (60) at its upper portion and with a discharging and filling portion (61) at its lower portion, respectively. The sucking port (54) and the discharging port (55) of the slide valve (53) are connected to the receiving hole (58) located at the vacuum sucking portion (60) and to the receiving hole (58) at the discharging and filling portion (61) in communication therewith, respectively.

The receiving holes (58) are cylindrically concaved in the peripheral side surface of the rotary disk (51). The center axes of the cylindrical receiving holes (58) are radially and equidistantly arranged from the center of the rotary disk (51). Arranged at the innermost portion of each of the receiving holes (58) is a rodlike amount-adjusting member (64) having a filter (63) at its leading end. Through this adjusting member (64) a receiving hole (58) is connected to the discharging port (54) or the sucking port (55) in communication therewith. The volume within a receiving hole (58) is adjusted by advancing or retreating the adjusting member (64) along the center axis of the receiving hole (58).

The agitator (57) arranged in the powder hopper (56) has its center axis (65) positioned horizontal, and its agitating blades (66) rotate in a vertical plane. An opening (59) of the receiving hole (58) positioned at the vacuum sucking portion (60) is arranged to face the interior of the powder hopper (56) from below and introduces a predetermined amount of powder (P) within the powder hopper (56) into the receiving hole (58) by the centrifugal force resulting from the agitation of the agitator (57) and the vacuum pressure from the sucking port (54).

The powder (P) introduced into the receiving hole (58) at the vacuum sucking portion (60) moves with the receiving hole (58) to the lower discharging and filling portion (61) by the intermittent rotation of the rotary disk (51).

Provided below the rotary disk (51) is a path (68) for transporting powder containers (67) such as vials. This path (68) is constituted to cooperate with a control wheel (69) for stopping a transport conveyor (70) and the powder containers (67) at a predetermined position so as to send the powder containers (67) to below the discharging and filling portion (61) in order. And when the rotary disk (51) is rotated and then a receiving hole (58) reaches the lower discharging and filling portion (61), the opening (59) is made to face the powder container (67) positioned therebelow and then the powder (P) accommodated within the receiving hole (58) is discharged by the discharging pressure from the discharging port (55) and filled into the powder container (67).

The above-mentioned conventional powder filling apparatus is employed for filling powdered pharmaceutical product and other various kinds of powder. Particularly, such a pharmaceutical product as injection being administered directly to a human body, it is strictly required to secure the exactness of the amount to be filled and prevent the contamination of foreign matters during the process of production. Therefore, for example, as to the apparatus for filling powdered injection of a pharmaceutical product, it is generally conducted to fill the powdered injection into such a container as a vial under the environment of a clean vertical laminar flow (F) having a cleanness class of not more than 100, as shown in FIG. 8.

However, the above-mentioned conventional powder filling apparatus which utilizes a rotary disk is constituted so that such devices likely to produce foreign matters when they slide, as the rotary disk (51), powder hopper (56) and slide valve (53) are arranged in the space above the transport path (68) for transporting the powder containers (67). Accordingly, there was a likelihood that foreign matters produced from the slide valve (53) or the sealing portion between the powder hopper (56) and the rotary disk (51) entered into the powder containers (67) positioned downstream of the laminar flow (F).

There was a further likelihood that the existence of the rotary disk (51) or the powder hopper (56) above the transport path (68) for the powder containers (67) such as vials caused a large turbulent flow to easily occur in the laminar flow (F), which resulted in winding up the dust or like foreign matters produced from the transport conveyor (70) by, the turbulent flow of the laminar flow (F) and entering them into the powder containers (67).

Further, in the above-mentioned conventional apparatus, the rotational axis (65) of the agitator (57) is arranged horizontally in the powder hopper (56). Therefore, since the powder (P) flows around a rotational axis sealing portion (71) formed in the side wall of the powder hopper (56), there was a likelihood that the powder (P) was entrapped into the sealing portion (71) to thereby damage the rotational axis (65) and enter the resulting metal pieces into the powder.

Moreover, there were such problems that the powder (P) existing within the powder hopper (56) at the upper portion thereof was pushed upward and therefore could hardly be flowed in the direction toward the receiving holes (58) of the rotary disk (51) since the agitating blades (66) were rotated in a vertical plane and that the filling accuracy depended on the physical property of the powder because it was difficult to adequately agitate the powder of bad flowability or the powder of large specific volume.

In addition, particularly in the case of filling a powdered pharmaceutical product such as powdered injection, it is necessary to prevent not only the pollution by bacteria or micro-organism but the mutual pollution caused when the kind of the powder is exchanged with any other one. Accordingly, although it is desired to be able to readily carry out the disassembling, washing, sterilizing, assembling and the like maintenance of the apparatus, the above-mentioned conventional apparatus could not be easily disassembled, so that there was a problem that the maintenance work required a full skill and therefore the operability was poor.

SUMMARY OF THE INVENTION

The present invention has an object to provide an apparatus for filling powder such as powdered injection of a pharmaceutical product, which is capable of prohibiting the turbulent flow of the laminar flow from occurring above the transport path for powder containers and removing the production of foreign matters in the powder hopper to prevent the contamination of foreign matters into the powder to thereby accurately fill various kinds of powder different in physical property.

The present invention has another object to provide an apparatus for filling powder in which the members contacting with the powder can be easily disassembled, washed, sterilized and assembled for maintenance and which is excellent in operability.

In order to accomplish the foregoing objects, the present invention comprises a rotary disk (1) provided with a plurality of receiving holes (8) equidistantly arranged at the peripheral edge portion thereof and with a vacuum sucking portion (9) and a discharging and filling portion (10), an intermittent rotation drive shaft (2) interlockingly connected to the rotary disk (1), a slide valve (3) having a sucking port (4) and a discharging port (5) connected to the respective of the receiving hole (8) positioned at the vacuum sucking portion (9) and the receiving hole (8) positioned at the discharging and filling portion (10) in communication therewith, and a powder hopper (6) having an agitator (7) arranged therein, an opening (8*a*) of the receiving hole (8) at the vacuum sucking portion (9), being arranged to face the interior of the powder hopper (6) so as to be able to introduce the powder (P) within the powder hopper (6) into the receiving hole (8) by the centrifugal force resulting from the agitation of the agitator (7) and the vacuum pressure from the sucking port (4), the opening (8a) of the receiving hole (8) at the discharging and filling portion (10) being opened above the powder container (26) positioned therebelow so as to be able to discharge the powder (P) accommodated in the receiving hole (8) by the discharging pressure from the discharging port (5) and fill it into the powder container (26), characterized in that a rotational axis (C) of the rotary disk (1) is inclined, the center axis of each of the receiving holes (8) being arranged on an imaginary conical surface (12) having this rotational axis (C) as its center axis and an apex angle (θ) within the range of 60° to 120°, the opening (8*a*) of the receiving hole (8) at the discharging and filling portion (10) being positioned at the lower portion of the receiving hole (8) and the opening (8*a*) of the receiving hole (8) at the vacuum sucking portion (9) being positioned on the lateral side of the receiving hole (8), the powder hopper (6) being disposed on the lateral side of the opening (8*a*) of the receiving hole (8) at the vacuum sucking portion (9), a boss portion (28) supporting a rotational axis (34) of the agitator (7) being arranged above the powder hopper (6).

Owing to the above constitution, it is possible to reduce the number of machine parts hanging over a path (42) for transporting the powder containers (26) and thereby suppress the occurrence of the turbulent flow in the laminar flow (F) with the result of easily maintaining the cleanness of the environment around the powder. containers (26). Further, since such devices easy to produce foreign matters as the vacuum sucking portion (9) and the powder hopper (6) are arranged away from the space above the transport path (42), there is no likelihood that foreign matters enter into the powder containers (26). Besides, the boss portion (28) of the agitator (7) is disposed above the powder hopper (6), so that the powder (P) is not entrapped into the rotational axis sealing portion to prevent the foreign matters from being produced by the damage of the rotational axis (34).

Further, the center axis of each of the receiving holes (8) being arranged on the imaginary conical surface (12), the adjusting member (14) located within a receiving hole (8) at the innermost portion thereof is advanced or retreated laterally and outwardly of the rotary disk (1) when adjusting the volume of the receiving hole (8). Unlike the prior art, it is not required to provide a space for advancing or retreating the adjusting member (14) toward the center of the rotary disk (1). In addition, since the adjusting member (14) is inclined with respect to the rotary disk (1), the diameter of the rotary disk (1) can be reduced even if there is provided an adjusting member (14) the length of which is the same as that of the prior art. As a result, for example, the rotary disk (1) can be reduced at the rate of 70% in diameter and at the rate of about 50% in weight when compared with the conventional apparatus, which in turn can facilitate the disassembling, assembling, adjusting, washing, sterilizing and the like maintenance work.

Further, the rotational axis (34) of the agitator (7) is disposed vertically and the agitating blades (35) are rotated laterally, so that the powder (P) within the powder hopper (6) is sucked into the center portion of the agitator (7) from above and sent out by centrifugal force in the outer peripheral direction. Therefore, the powder (P) makes a convection current within the powder hopper (6) and is fluidized to be smoothly supplied into the receiving holes (8) of the rotary disk (1). As a result, the agitator (7) and the powder hopper (6) can be made compact and easy to handle. Besides, the powder amount to be contained in the powder hopper (6) can be largely reduced, for example, to 25% of that of the conventional apparatus and therefore the loss of the powder (P) can be decreased.

Further, the present invention is characterized by constituting the powder hopper (6) from an upper container (6*a*) having an upper container opening at its lower end and a lower container (6*b*) having an lower container opening at its upper end, the upper container (6*a*) being separably and airtightly fixed to the lower container (6*b*) by a container fastening member (27), the boss portion (28) of the agitator (7) being detachably secured to the upper container (6*a*) by a boss fastening member (29).

Owing to the above constitution, the powder hopper (6) can be easily disassembled by detaching both fastening members (27),(29) and therefore its maintenance can be performed with ease.

Furthermore, the present invention is characterized by rotatably arranging a hollow rotation drive shaft (33) at the boss portion (28) of the agitator (7), the rotation drive shaft (33) being interlockingly connected to an agitator driving device (31), the rotational axis (34) of the agitator (7) being removably inserted into the rotation drive shaft (33) from therebelow and fixed thereto.

Owing to the above constitution, the agitator (7) can be easily detached and its maintenance can be conducted with ease.

Moreover, the present invention is characterized by attaching auxiliary blades (36) to the rotational axis (34) of the agitator (7).

Owing to the above constitution, the shape, attaching angle, number and the like of the auxiliary blades are suitably selected in accordance with the material of the powder so as to fluidize the powder (P) within the powder hopper (6) to an even and necessary density. As a result, for example, the powder of large specific volume can be also filled with a high density to result in the possibility of increasing the filling accuracy.

BRIEF DESCRIPTION OF THE DRAWINGS

FIG. 1 is a vertical sectional side view of this apparatus. FIG. 2 is a front view of this apparatus. FIG. 3 is a plan view of this apparatus. FIG. 4 is a side view of an agitator. FIG. 5 is a plan view of a slide valve. FIG. 6 is a sectional view taken along the line 6—6 of FIG. 5. FIG. 7 is an enlarged vertical sectional view of an essential part of a rotary disk. FIG. 8 is a vertical sectional side view and Fig. a front view. FIG. 10 is a plan view.

DETAILED DESCRIPTION OF THE PREFERRED EMBODIMENT

Hereafter the present invention is explained in more detail with reference to the attached drawings.

Figure 1:
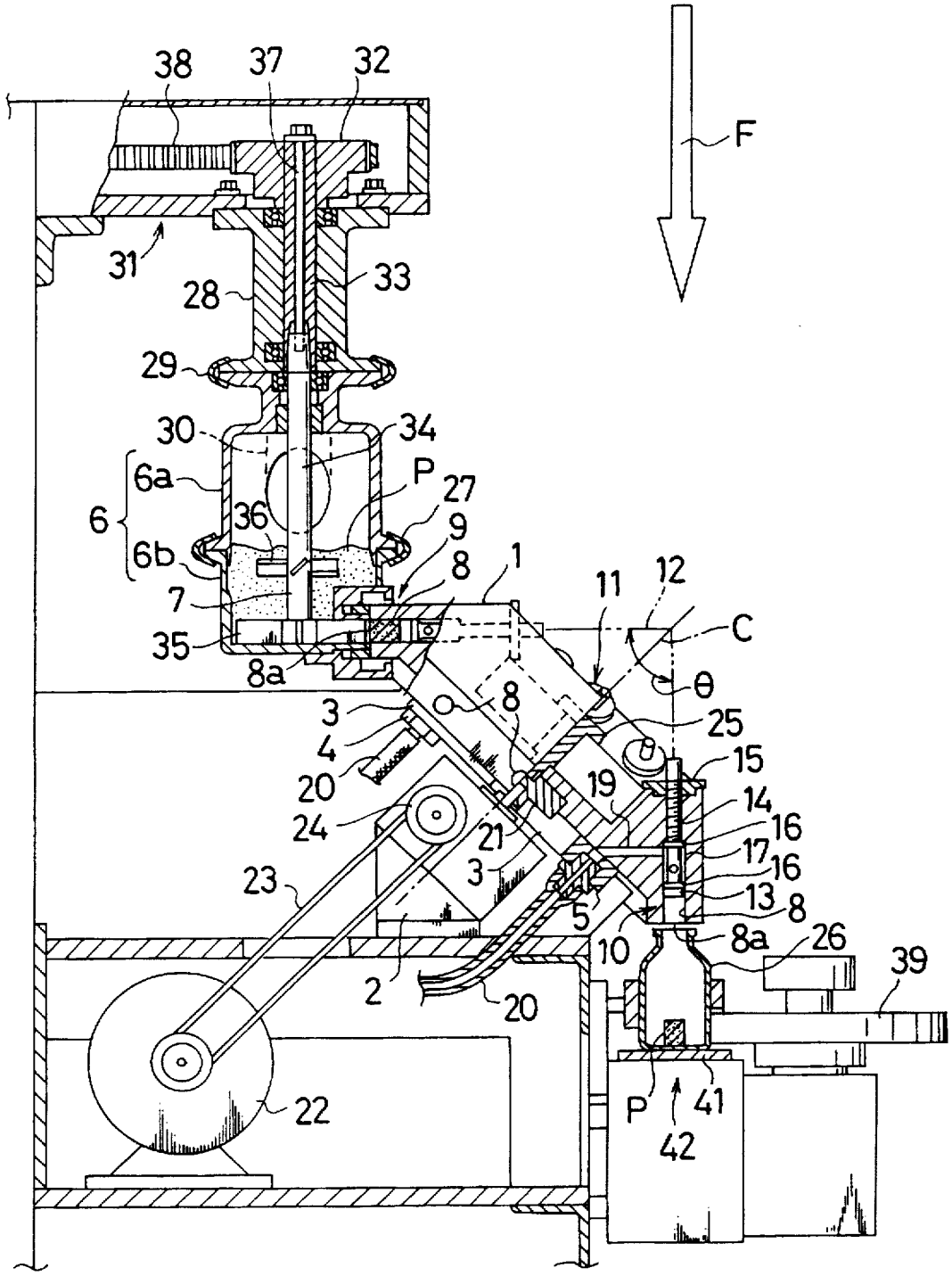
FIGS. 1 to 7 show a preferred apparatus for filling powder according to the present invention.

As shown in FIG. 1, the powder filling apparatus of the present invention comprises an umbrella-like rotary disk (1) having a rotational axis (C) inclined with respect to the horizontal plane by an angle of 45°, an index device (2) which is an intermittent rotation driving device interlockingly connected to the rotary disk (1), a slide valve (3) having a sucking port (4) and a discharging port (5), and a powder hopper (6) having a horizontally rotatable agitator (7) arranged therein, a path (42) for transporting powder containers (26) being formed below the rotary disk (1), a clean laminar flow (F) being flowed from above to below around the whole apparatus.

Figure 2:
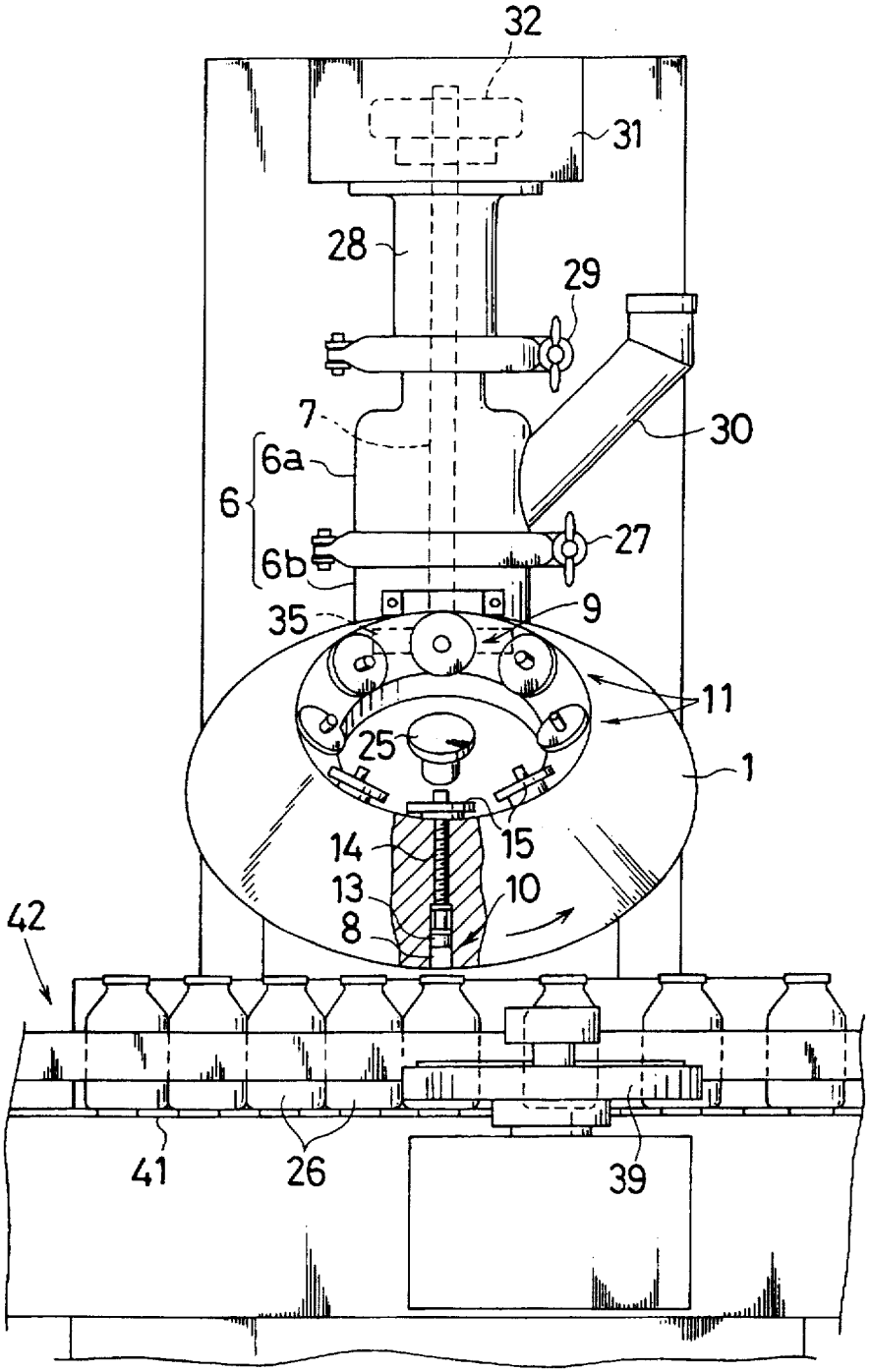

As shown in FIG. 2, the umbrella-like rotary disk (1) is formed with eight cylindrical receiving holes equidistantly arranged at its peripheral edge portion, a vacuum sucking portion (9) being provided at its uppermost portion while a discharging and filling portion (10) being disposed at its lowermost portion, a discharging and cleaning portion (11) being provided between the discharging and filling portion (10) and the vacuum sucking portion (9).

Figure 7:
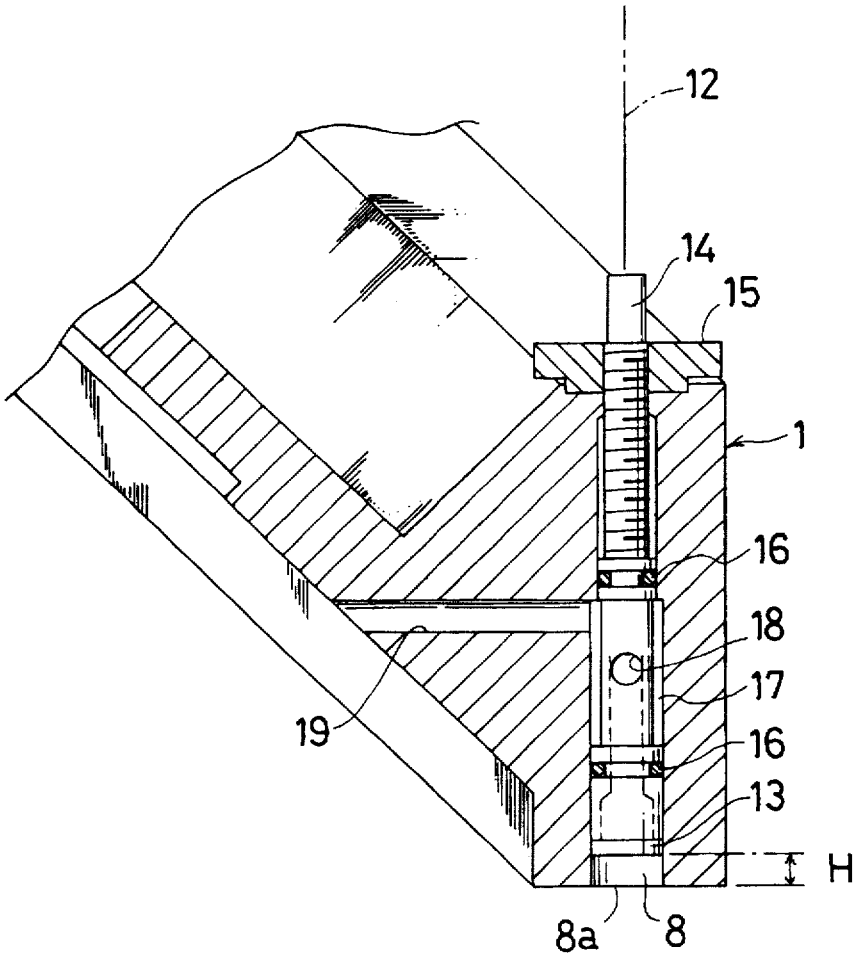

The receiving holes (8) are formed on an imaginary conical surface having the rotational axis (C) of the rotary disk (1) as its center axis and an apex angle (θ) of 90°, and a rodlike adjusting member (14) having a filter (13) at its leading end is arranged at the innermost portion of each of the receiving holes (8). This adjusting member (14) is, as shown in FIG. 7, locked to the imaginary conical surface (12) by a locking screw so as to be adjustable for advancing or retreating on the conical surface (12). The powder amount to be filled is adjusted by loosening the locking screw (15) to spirally move the adjusting member (14) and changing the depth (H) of each of the receiving holes (8) to regulate the volume of each receiving hole (8).

Figure 8:
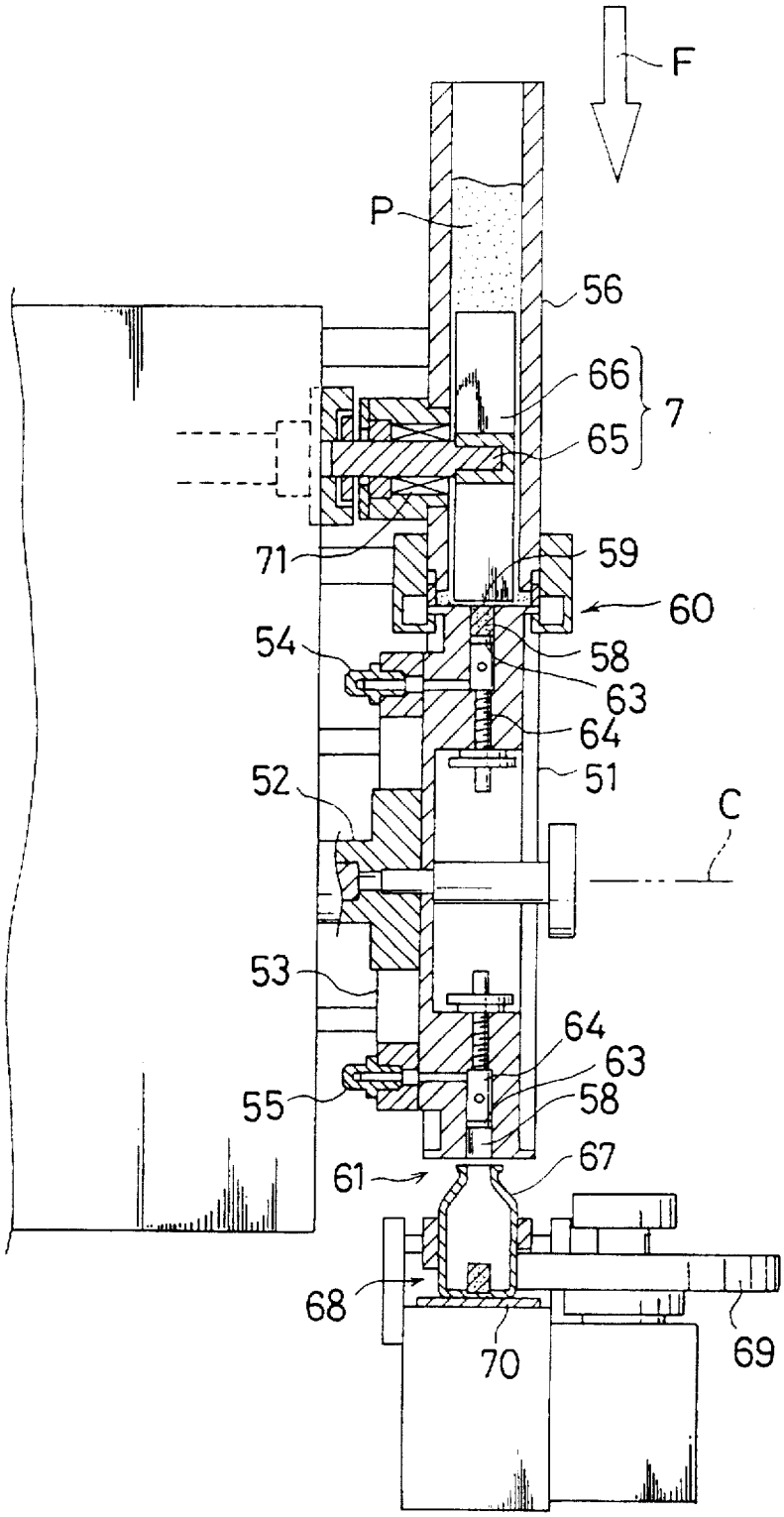
FIGS. 8 to 10 show a prior art.
Figure 9:
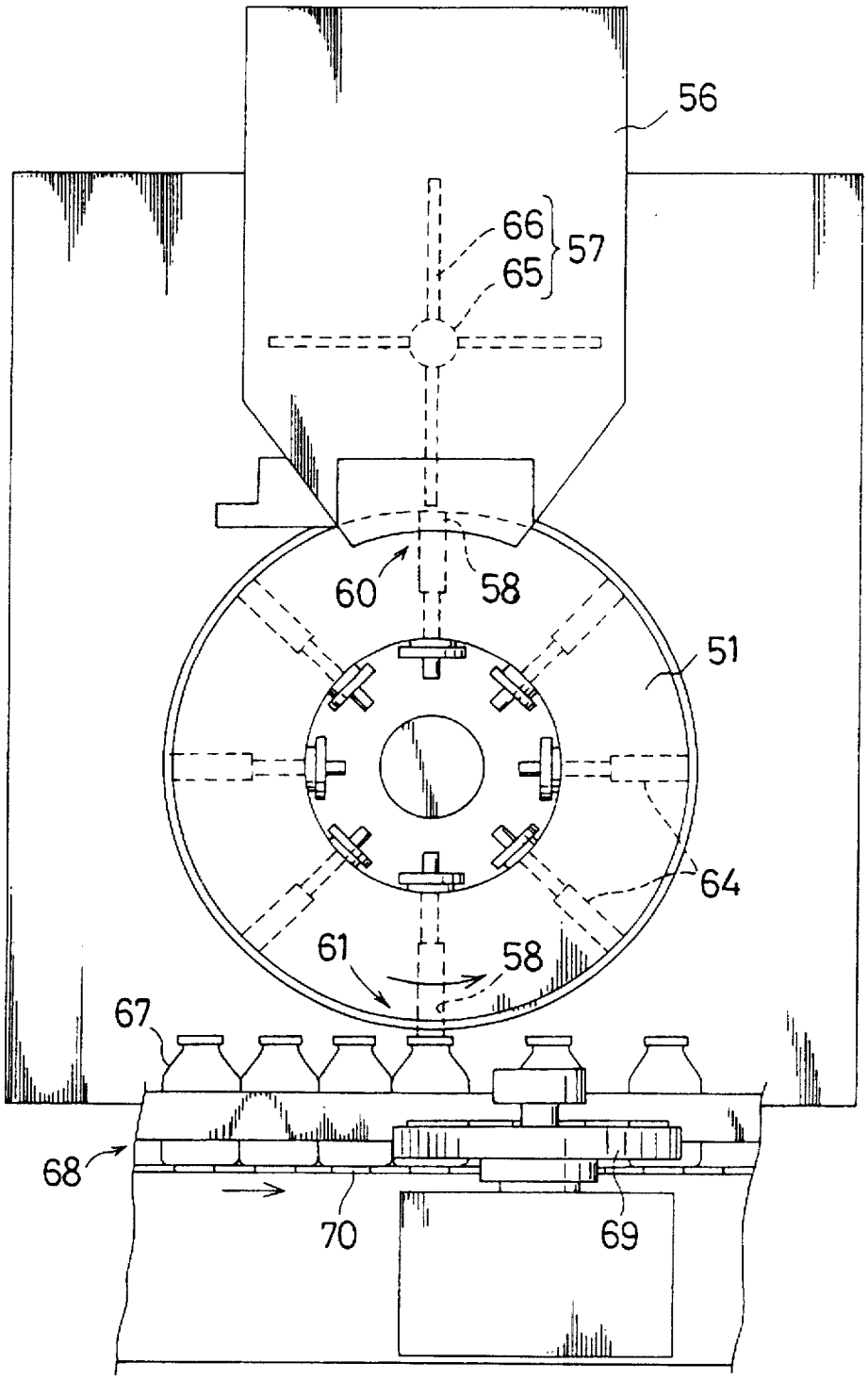
Figure 10:
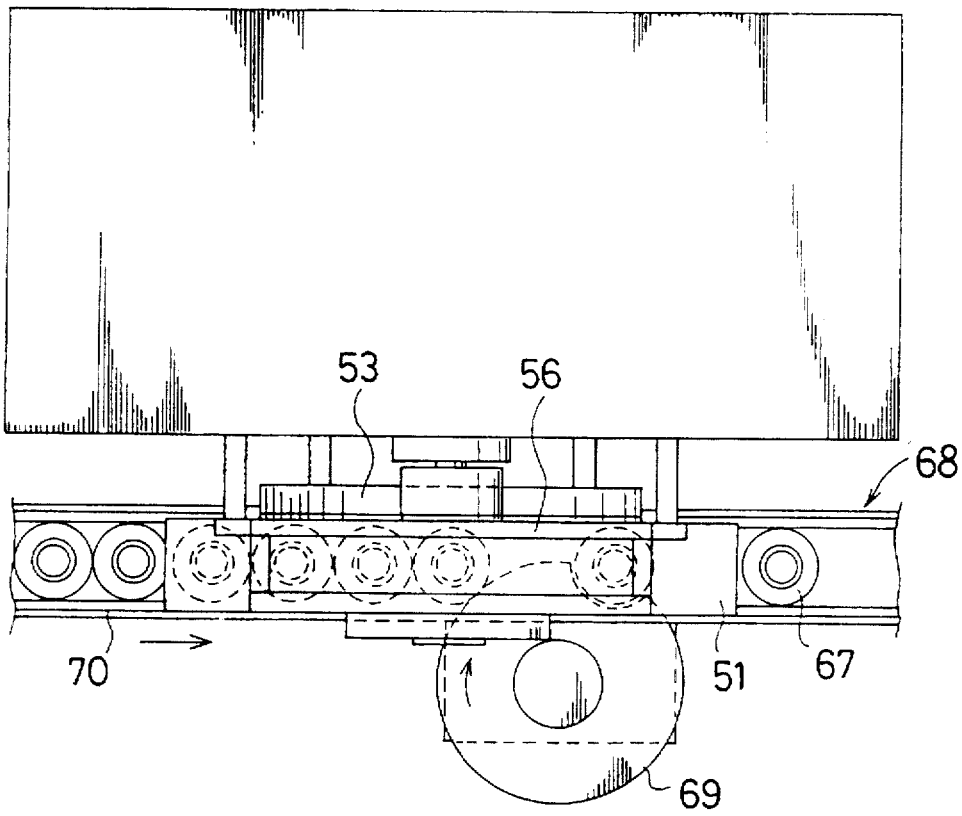

When regulating the volume of a receiving hole (8), as shown in FIG. 1, the adjusting member (14) is moved into an external space of the rotary disk (1) along the imaginary conical surface (12), so that the adjusting member (14) can be regulated with an extreme ease unlike the prior art shown in FIG. 8 which moves the adjusting member (14) in the direction toward the center of the rotary disk (1). Besides, as shown in FIG. 7, since the adjusting member (14) is inclined with respect to the rotary disk (1) by an angle of 45°, the rotary disk (1) can be made 70% shorter in diameter and about 50% lighter in weight than the prior art even if it is provided with an adjusting member (14) of the same length as that of the prior art.

O-rings (16,16) are arranged around the adjusting member (14) at the portion near to its leading end and at its intermediate portion respectively to thereby form a communicating space (17) around the adjusting member (14). The communicating space (17) is made to communicate with a receiving hole (8) through a communicating bore (18) formed in the adjusting member (14) and the filter (13) on the leading end thereof and to be connectable in communication with the sucking port (4) or the discharging port (5) of the slide valve (3) through another communicating bore (19) formed in the wall of the rotary disk (1).

The slide valve (3) is, as shown in FIG. 1, arranged to be unable to rotate downwardly along the rotary disk (1) and is provided with the sucking port (4) and the discharging port (5) at the respective of its upper and lower portions, which ports are connected in communication with a vacuum source and a pressurized air supply source (not shown), respectively, through a connecting pipe (20).

Figure 5:
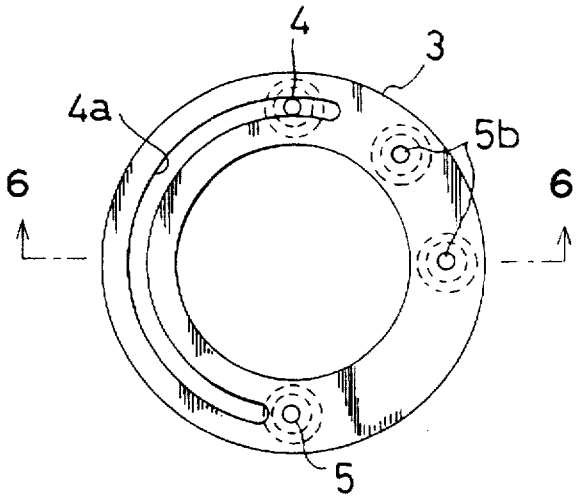
Figure 6:
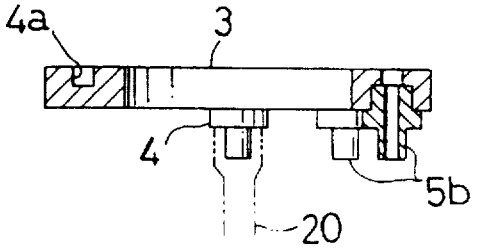

This slide valve (3) is, as shown in FIG. 5, formed with a vacuum groove (4*a*) extending from the sucking port (4) just before the discharging port (5). Further, provided at two portions between the discharging port (5) and the sucking port (4) are cleaning and discharging ports (5b).

An output shaft (21) of the index device (2) is inclined with respect to the horizontal plane by an angle of 45°. On driving an input shaft (24) through a transmission belt (23) by a driving motor (22), the output shaft (21) is counterclockwisely rotated by an angle of 45° when seen from the front side and then stopped.

Being fixed to this output shaft (21) by a set bolt (25), the rotary disk (1) performs such an intermittent rotation that repeats the counterclockwise rotation made by an angle of 45° when seen from the front side and the stopping. Further, since the rotational axis (C) of the rotary disk (1) is inclined with respect to the horizontal plane by an angle of 45°, as shown in FIG. 1, while the opening portion (8*a*) of the receiving hole (8) is opened downward just above the powder container (26) at the discharging and filling portion (10), the opening (8*a*) is opened toward the agitator (7) of the powder hopper (6) located on the lateral side thereof at the vacuum sucking portion (9).

This powder hopper (6) is constituted from an upper container (6*a*) having an opening at its lower end and a lower container (6*b*) having an opening at its upper end. The upper container (6*a*) is airtightly fixed to the lower container (6*b*) by a container clamp (27). In addition, the upper container (6*a*) is airtightly secured to the boss portion (28) of the agitator (7) by a boss clamp (29). The powder (P) is supplied into the powder hopper (6) through a chute (30).

Since either of the upper container (6*a*) and the lower container (6*b*) can be easily made to have such a structure that it has no angle at its corners, the corners at the portions to which the powder (P) attaches are each arcuately formed in section and therefore they can be washed without difficulty.

The boss portion (28) of the agitator (7) is secured to the lower surface of an agitator driving device (31). A hollow rotation drive shaft (33) fixed to a driving pulley (32) of the agitator driving device (31) is vertically inserted through the boss portion (28) to be rotatably supported thereby.

Figure 4:
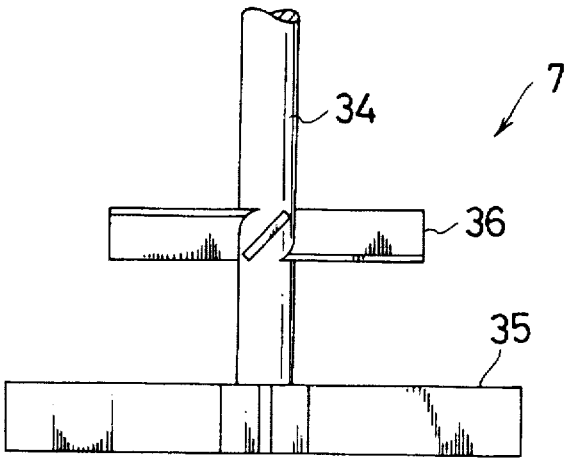

The agitator (7) within the powder hopper (6) is fixed by a fastening screw (37) with its rotational axis (34) inserted into the rotation drive shaft (33) from below and is rotated through a timing belt (38) and the driving pulley (32) by an agitator driving motor (not shown). The rotational axis (34) of the agitator (7) is, as shown in FIG. 4, provided with four agitating blades (35) attached to its lower end and with four auxiliary blades above the agitating blades (35), respectively. The powder (P) within the powder hopper (6) is agitated and fluidized through these agitating blades (35) and auxiliary blades (36). Please note the auxiliary blades (36) may be either changed in shape or number, or omitted depending on the kind of the powder (P).

A predetermined amount of the powder (P) fluidized within the powder hopper (6) is entered into the receiving hole (8) positioned at the vacuum sucking portion (9) of the rotary disk (1) through the centrifugal force caused by the agitator (7) and the vacuum pressure from the sucking port (4) of the slide valve (3) connected to a vacuum source.

The powder (P) entered into this receiving hole (8) is, as shown in FIG. 5, sucked and held by the vacuum pressure applied through the vacuum groove (4*a*) of the slide valve (3). Then when the index device (2) drives the rotary disk (1) to rotate by an angle of 180° and the receiving hole (8) reaches the discharging and filling portion (10), as shown in FIG. 7, pressurized air is supplied through the communicating hole (19), communicating space (17), communicating bore (18) of the adjusting member (14) and filter (13) in order from the discharging port (5) of the slide valve (3). Owing to this air pressure, the powder (P) within the receiving hole (8) is discharged and filled into the powder container (26) positioned therebelow.

The receiving hole (8) which has discharged the powder (P) is moved by the rotation of the rotary disk (1) to the discharging and cleaning portion (11) and given pressurized air from the cleaning and discharging ports (5*b*) of the slide valve (3) to discharge the powder which clogged the filter (13) and to be thereby cleaned.

Figure 3:
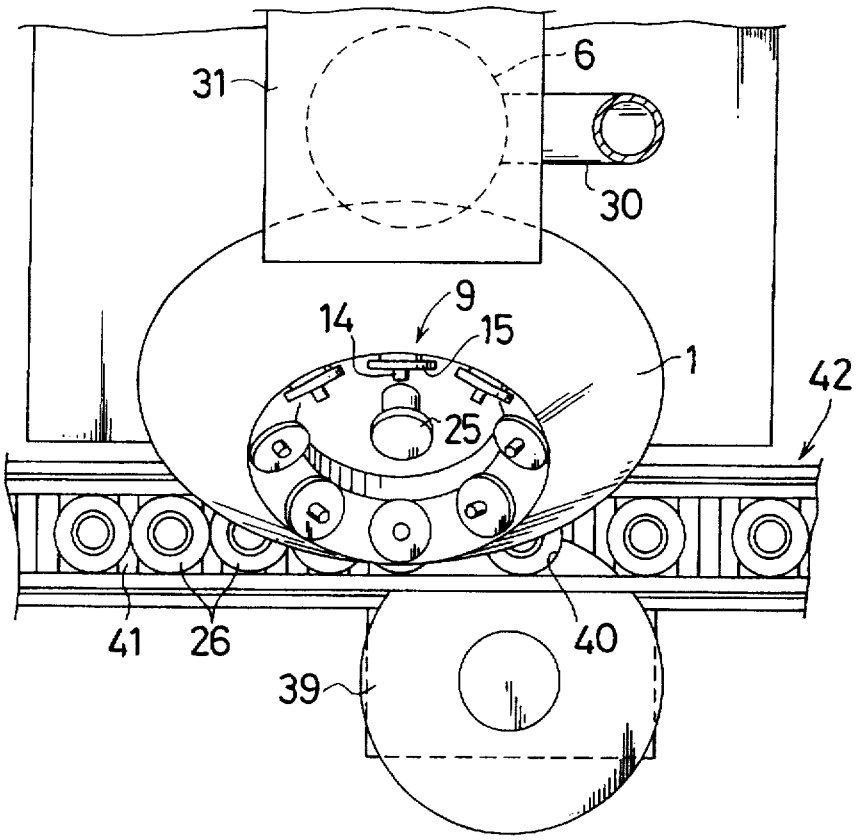

The powder containers (26) to be transferred on the transport path (42) below the rotary disk (1) are, as shown in FIGS. 2 and 3, moved from the left to the right in the drawing and stopped synchronously with the stopping time of the rotary disk (1) immediately below the discharging and filling portion (10) by a control wheel (39) for stopping the powder containers (26) at a predetermined position for a fixed period of time. When the filling of the powder (P) is completed, the powder containers (26) are transferred in the rightward direction on a transport conveyor (41) by the control wheel (39) coincidentally with the rotation of the rotary disk (1).

The control wheel (39) is, as shown in FIG. 3, provided with a concave (40) in accordance with a part of the external outline of a powder container (26). Each time this control wheel (39) makes one rotation, a powder container (26) can be intermittently transported in accordance with the powder filling cycle performed by the rotary disk (1).

In the above embodiment, an umbrella-like rotary disk was used so as to reduce the weight. However, according to the present invention it suffices if the rotational axis of the rotary disk is inclined, and the rotary disk may be a cylindrical disk.

Further, it is sufficient if the intermittent rotation driving device is a device capable of intermittently rotating the rotary disk, and therefore it is not limited to the index device. In addition, the rotary disk may be interlockingly connected to the output shaft of the intermittent rotation driving device indirectly through a transmission mechanism instead of directly connecting it thereto.

Moreover, vertical arrangement of the center axis of the receiving hole at the discharging and filling portion facilitates the filling into the powder container. Consequently, in this case, if the apex angle of the imaginary conical surface is different from 90°, the center axis of the receiving hole at the vacuum sucking portion is inclined. On the other hand, it is preferable to make the centrifugal force caused by the agitator act on the receiving hole at the vacuum sucking portion in the direction of the center axis. Accordingly, it is advantageous to incline the agitator or the powder hopper in the direction perpendicular to this inclined center axis.

Please note the pressurized gas supplied from the discharging port is not limited to air and that nitrogen or other gas may be employed.

Moreover, although in the above embodiment a vial was used as a powder container, a bag or other container may be utilized. In addition, a chute or the like may be arranged below the discharging and filling portion and the powder may be filled into the powder container through this chute or the like As mentioned above, the present invention is useful as an apparatus for filling various kinds of powder into each of powder containers by a predetermined amount and especially suitable for being used at the step of filling into vials or the like containers, the powdered pharmaceutical product such as injection which requires the accuracy of the amount to be filled and the non-contamination of foreign matters.

I claim:

1. An apparatus for filling powder, comprising:

a rotary disk with a peripheral edge portion having a plurality of receiving holes equidistantly arranged therealong, a vacuum sucking portion and a discharging and filling portion; said rotary disk having a rotational axis which is inclined with respect to a support surface, said receiving holes each having a center axis arranged on an imaginary conical surface having said rotational axis as a center axis and an apex angle within a range of 60° to 120°;

an intermittent rotation driving device interlockingly connected to said rotary disk;

a powder hopper having an agitator arranged therein which is rotatably supported for rotation about an agitator rotational axle and a boss portion located above said powder hopper, said boss portion supporting said agitator for rotation about said agitator rotational axle; and a slide valve having a sucking port selectively connectable so as to be in communication with a first one of said receiving holes that is positioned at said vacuum sucking portion and a discharging port selectively connectable so as to be in communication with a second one of said receiving holes positioned at said discharging and filling portion; said first and second ones of said receiving holes having a first opening and a second opening, respectively; said first opening located on a lateral side of said first one of said receiving holes and said powder hopper disposed on said lateral side of said first one of said receiving holes; said second opening located at a lower portion of said second one of said receiving holes;

wherein said first opening is positionable to face an interior of said powder hopper so as to enable introduction of a powder within said powder hopper into said first one of said receiving holes by a centrifugal force resulting from agitation of said agitator and a vacuum pressure from said sucking port and said second opening is openable above a powder container adapted to be positioned therebelow on said support surface so as to enable discharge of an amount of powder accommodated in said second one of said receiving holes by a discharge flow from said discharging port to fill said amount of powder into said powder container.

2. An apparatus for filling powder according to claim 1, wherein said powder hopper comprises an upper container having an upper container opening at a lower end thereof and a lower container having a lower container opening at an upper end thereof, said upper container being separably and airtightly fixed to said lower container, said boss portion of said agitator being detachably secured to said upper container.

3. An apparatus for filling powder according to claim 2, including auxiliary agitating blades attached to said rotational axle of said agitator.

4. An apparatus for filling powder according to claim 1, wherein said agitator includes an agitator driving device and a hollow rotation drive shaft arranged in said boss portion and interlockingly connected to said agitator driving device, said rotational axle of said agitator being removably inserted into said drive shaft and secured thereto.

5. An apparatus for filling powder according to claim 4, including auxiliary agitating blades attached to said rotational axle of said agitator.

6. An apparatus for filling powder according to claim 1, including auxiliary agitating blades attached to said rotational axle of said agitator.

* * * * *